United States Patent [19]

Price

[11] 4,181,459

[45] Jan. 1, 1980

[54] CONVEYOR PROTECTION SYSTEM

[75] Inventor: Charles A. Price, Portage, Ind.

[73] Assignee: United States Steel Corporation, Pittsburgh, Pa.

[21] Appl. No.: 882,495

[22] Filed: Mar. 1, 1978

[51] Int. Cl.[2] ..... C10B 31/04

[52] U.S. Cl. ..... 414/161; 414/163; 414/148; 198/573; 198/502; 198/856; 414/786

[58] Field of Search ..... 414/148, 161, 163, 270, 414/786; 198/502, 573, 856

[56] References Cited

U.S. PATENT DOCUMENTS

| | | | |
|---|---|---|---|
| 2,674,381 | 4/1954 | Cady | 414/270 |
| 3,342,351 | 9/1967 | Sinjavsky et al. | 414/270 X |
| 4,049,141 | 9/1977 | Rohde et al. | 414/161 |

*Primary Examiner*—Albert J. Makay

*Attorney, Agent, or Firm*—Arthur J. Greif

[57] ABSTRACT

In the handling and charging of pre-heated coal, the coal is transported from a coal storage container to the oven chambers by an enclosed continuous conveyor system. The coke oven chambers are charged individually in a continual manner by transporting a measured amount of coal from the container, sufficient to fill a respective chamber. If coal, due to a malfunction, passes beyond the intended charging hole, it can jam the drive area causing extensive damage. To prevent this, a safety device is provided which includes a sensing device, e.g. a pivotally mounted switch for determining the presence of coal on the conveyor and associated therewith, a time delay system for determining if a particular amount of coal, to which the sensor is responding, is of sufficient volume to cause jamming of the conveyor drive system.

5 Claims, 3 Drawing Figures

CONVEYOR PROTECTION SYSTEM

Figure 1:
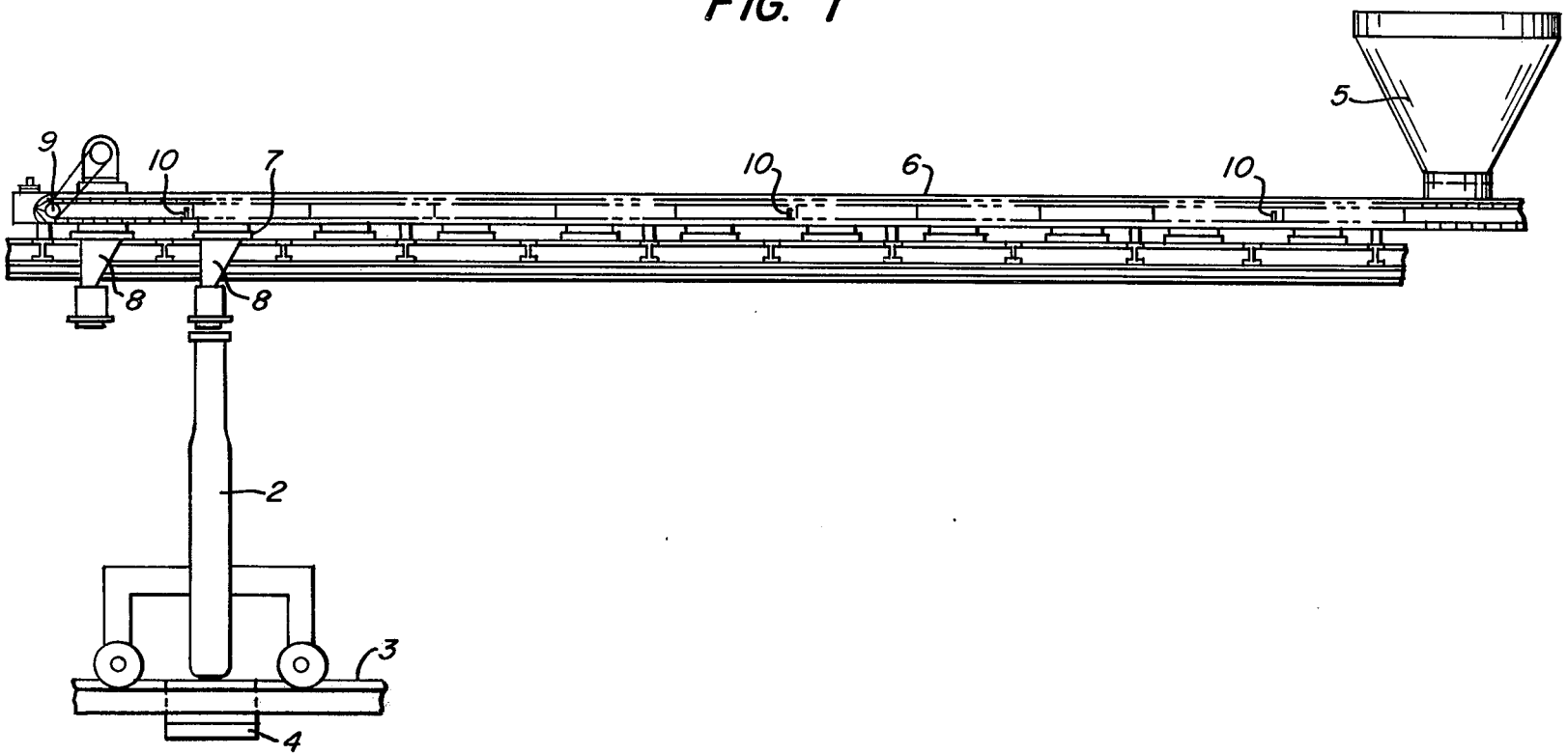

This invention relates to a safety device, particularly useful for protecting the drive area of continuous conveyor systems conducting moist or preheated coal for the charging of coke ovens. A rather recent development for the charging of coal into a coke oven are those in which preheated coal is transported from a storage bunker or container to the coke ovens by means of a hermetically sealed, continuous conveyor system. The basic operations of such systems is described, for example, in U.S. Pat. No. 3,707,237, the disclosure of which is incorporated herein by reference. Such systems generally comprise four basic elements: (1) a metering device, connected to or incorporated within the coal storage container, for measuring an amount of coal corresponding approximately to the effective volume of the oven to be charged; (2) a continuous conveying means, generally in the form of a chain conveyor, for transporting the measured amount of coal to its associated coke oven; (3) a coke oven battery, comprising an array of coke ovens, each having one or more charging holes for receiving the measured amount of coal and (4) a vertical conduit for connecting an opening in the conveyor system (controlled, for example, by a slide gate) with a respective coke-oven charging hole.

The operation of such systems, particularly as they relate to the use of mobile vertical conduits (known in the trade as a "buggy") is as follows. When an oven is designated for charging, the buggy is located over the designated oven's charging holes, and slide gates are opened to make that oven ready to receive coal. A predetermined amount of coal is then transported from the measuring bins, via the hermetically-sealed chain conveyors, to that oven's charging holes. After but a few minutes, when the coal reaches the proper level in the oven, generally determined by a level measuring device, an electrical circuit is opened either manually or automatically so as to stop the transportation of additional coal. Frequently, conditions occur in which a volume of coal will pass beyond its intended departure point on the chain conveyor. Most such conveyors are constructed as to enable continued operation if small volumes of coal pass the intended departure point and are carried forward into the chain drive system. However, for every chain conveyor system there exists a volume of coal which is "excessive" and will result in the jamming of the drive system. The art has resorted primarily to two basically different solutions to this problem. One such solution utilizes a separate endless chain conveyor for transporting such excess coal to a point where it can no longer damage the main conveyor system. The use of separate conveyor systems, necessarily associated with each main conveyor system, although effective, results in significantly higher capital and operating expenses. The second solution resides in the installation and use of either a baffle plate near the end of each chain conveyor (shown in the U.S. Pat. No. 3,707,237 patent) or a large metal harness at the tail end of the conveyor. In theory, the sudden jamming action of the coal upon entering the drive area is supposed to disturb the harness sufficient to activate a switch and shut the conveyor down. In practice, this latter solution has been found to be rather ineffective. Thus, such harnesses have often failed to respond with the sensitivity and rapidity necessary for protection of the chain drive system. On the other hand, when the sensitivity of such harnesses is enhanced, it is then found that the conveyor is often shut down, even for volumes of coal which would create no problems for the drive system. In the use of this latter harness-type safety system the art therefore had to choose between excessive damage to the equipment and the associated down-time required to repair such equipment or loss of coke production and productivity resulting from too frequent and unnecessary shut-downs.

The instant invention is constructed so as to indicate if amounts of coal continuing past the intended point of departure are "excessive", while permitting the conveyor operation to continue if such amounts of coal are insignificant. The instant device primarily incorporates (i) a sensor, preferably a pivotably mounted switch which is both sturdy, but may nevertheless be activated by even relatively minor amounts of coal on the conveyor system and (ii) a time-delay system which can either automatically determine or indicate to an operator if a particular amount or slug of coal which initially activated the switch is of a volume which may pass through the chain drive area or is "excessive", i.e. an amount which would jam and damage the drive system.

Figure 2:
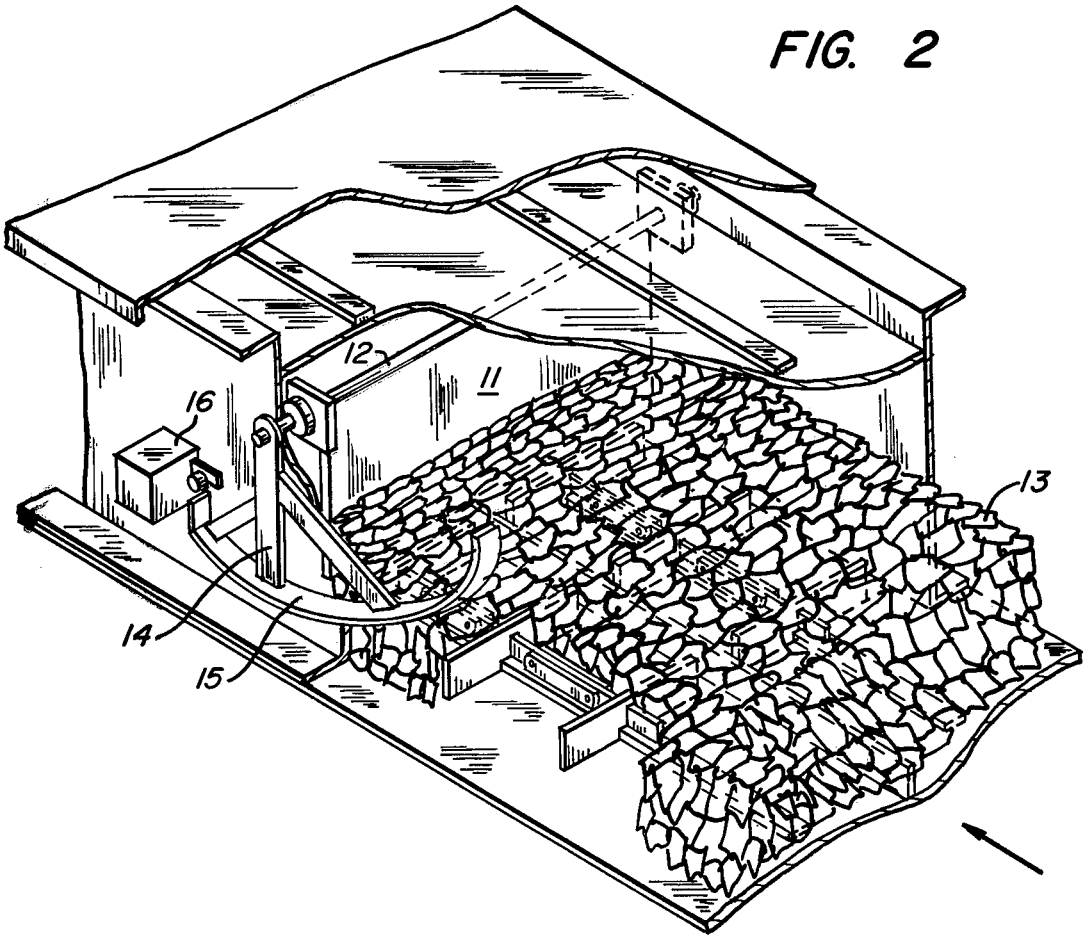
Figure 3:
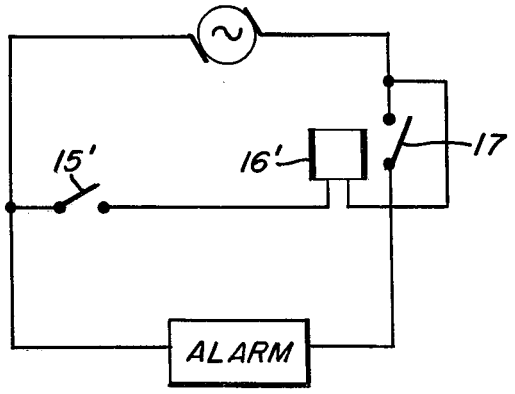

The operation and advantages of the instant invention will better be understood by reference to the following description when read in conjunction with the appended claims and drawings in which:

FIG. 1 is a representational drawing of an enclosed conveyor for charging coke ovens, FIG. 2 is a drawing of a preferred sensor for indicating the presence of a predetermined minimum volume of coal on the conveyor, and FIG. 3 is a diagram of a circuit for determining if an amount of coal is "excessive".

FIG. 1 shows an enclosed continuous conveyor system for charging coke ovens, similar to that of the U.S. Pat. No. 3,707,237 patent noted above, with the exception that funneling of the coal from the conveyor to the oven-charging hole is accomplished by use of a mobile conduit, buggy 2. A buggy is an elaborate funnel that moves on rails 3 (similar to the more conventional larry car) to permit movement over the entire length of the coke oven battery. When an oven is ready for charging, the buggy operator locates a buggy over the designated oven's charging holes 4 and then opens the valves and slide gates requisite to making the oven ready to receive coal. The buggy operator then contacts the coal charging operator who in turn will discharge a predetermined amount of coal from the measuring bins 5 via the chain conveyor 6 through slide gate 7, redeler assembly 8 (only two of which are shown for simplicity), charging buggy 2 and into the oven (not shown). A shut-off device normally will automatically stop the feed of coal into the oven and, through interlocks, the whole system should stop transporting coal. Under proper operating conditions, virtually no coal should pass beyond the intended departure point, i.e. the charging hole of the oven specifically associated with that measured amount of coal. However, a variety of conditions are encountered which result in coal continuing past the intended slide gate 7. Examples of conditions which have actually occurred, resulting in coal travelling past its departure point are (a) failure of gates or valves to open, (b) human error, e.g. the operator moving the buggy to the wrong oven and (c) overfilling of the oven, due to malfunction of the probes or other devices designed to prevent such overfilling. Whatever the reason for coal continuing past its intended departure point, serious damage may occur when such coal, e.g. at an average height of ten inches gets rammed into the chain return area 9 which may have a "clear area" of say only 3 inches.

Such jamming of the drive area is prevented in the instant invention by initially sensing if and when coal is present on the conveyor system at a point past its intended departure and thereafter determining if the sensed amount of coal is "excessive" i.e. a volume of coal which would cause such jamming. A variety of devices, pressure sensors, weight sensors, electric eyes, etc. may be employed for sensing the presence of coal. Obviously, to be effective, such sensors must be interposed at one or more points between the charging hole (actually the slide gate in the conveyor system) closest to and the charging hole farthest from the storage container. Desirably, a number of such sensors 10 will be employed and strategically spaced, for example after approximately every three to five slide gates (as shown in FIG. 1) or most preferably after every slide gate, to provide enhanced response for protection of the drive area. When a number of sensors are employed, the sensors which are upstream of the intended discharge point will also sense the presence of coal during the time it is being delivered to the intended charging hole. Therefore, some provision must be made to by-pass such upstream sensors to prevent their indicating a "fault situation" when none really exists. This may easily be accomplished, for example, by utilization of a selector switch (either manual or automatic) for energizing only those sensors which are downstream of the intended discharge point, or only the one immediately downstream sensor. Alternatively, in the preferred embodiment in which sensors are employed immediately downstream of each slide gate, the opening of a specific slide gate (i.e. the intended gate) could simultaneously effect the energization of its associated sensor (or the energization of the timer).

A particularly preferred sensor device, which has proved to be both durable and reliable is shown in FIG. 2, and is comprised of a burden plate 11 pivotally mounted to shaft 12 so as to raise and allow coal 13 to pass. Pivotally mounted to move in unison with plate 11 is burden arm 14 which in turn is connected to burden rocker 15. When coal contacts the burden plate, it raises causing the rocker to trip an electric limit switch 16, in turn energizing a time-delay relay (TDR). The timing device of the time-delay system is preset to a time period (e.g. 4 seconds) which is the passage time for a "length of coal" (actually a "volume of coal" since the moving front of coal has both width and height) which has been determined to be "excessive". Thus, as long as a predetermined minimum height of coal is passing burden plate 11 causing it to raise sufficiently to energize limit switch 16, the timer will remain energized. If this energizing condition exists past the time period preset on the timing device, a second switch may be thrown which may (a) automatically stop the conveyor, (b) signal the conveyor operator of a "fault condition" or (c) do both. In any event, the tripping of the timing device signals the operator that an "excessive" amount of coal is on the conveyor past its intended discharge point. For systems employing a mobile conduit such as a buggy, the operator will then move the buggy back to the upstream point where the excess coal is indicated to exist. Since the upstream slide gates which lie under the area of excess coal will be closed, the operator will open those gates and, for example, permit such excess merely to drop onto the roof of the oven below. Alternatively, a specific receptacle may be provided for receiving such excess, e.g. use of a trailer buggy. If, however, burden plate 11 returns to its rest position as the result of the passage of less than an "excessive" amount of coal, limit switch 16 is opened, breaking power to the timer, prior to the expiration of the preset time-interval. Desirably, the timer will have an integral reset mechanism forcing it back to zero, rendering it ready to time a new interval for a subsequent slug of coal on the conveyor.

An alternate TDR system for preventing unnecessary shut-downs of the conveyor when the amount of coal is not "excessive" is shown in circuit diagram, FIG. 3. As above, limit switch 15' is closed when coal is present, thereby energizing coil 16'. The normally open contacts 17 of the TDR have a delay feature (e.g. a dashpot device such as an AGASTAT timer) which permits them to operate (close and energize the ALARM) when coil 16' has been energized continuously for the preset time-interval, analogous to a volume of coal which would be "excessive" for the conveyor in question.

I claim:

1. In an apparatus for charging an array of coke ovens forming a coke oven battery, said apparatus including a coal storage container, an enclosed, continuous conveyor for transferring a defined amount of coal from the storage container to a coke oven charging hole associated with said defined amount of coal, said enclosed conveyor overlying the charging holes of the coke ovens;

the improvement, for preventing jamming of the conveyor drive system when at least a portion of said defined amount of coal is not charged into its associated charging hole, which comprises;

sensor means responsive to a predetermined minimum volume of coal on the conveyor, said sensor means being interposed along the length of the conveyor, at a point between the charging hole closest to and the charging hold farthest from said storage container;

time-interval measuring means, initiated by said sensor and preset to be analogous to an excessive volume of coal which would cause such jamming, means for preventing said time-interval measuring means from being initiated by a sensor, upstream of the coke oven charging hole associated with said defined amount of coal, means for comparing (i) the time-interval said sensor is responding to the presence of said predetermined minimum volume of coal on the conveyor with (ii) said preset analogous time-interval, and associated with said comparing means, means for generating a signal when time-interval (i) is greater than time-interval (ii).

2. The apparatus of claim 1, in which said sensor means include a plate member mounted so as to move pivotally when struck by said predetermined minimum volume of coal, whereby such pivotal movement initiates the response of time-interval (i).

3. The apparatus of claim 2, in which at least one such sensor means is employed, on the average, for every five coke ovens in said battery, at distances approximately equal therebetween.

4. In the charging of an array of coke ovens forming a coke oven battery, wherein said coke ovens are filled by transporting a defined amount of coal from a storage container to a coke oven charging hole associated with said defined amount of coal, said transporting being accomplished through the use of a substantially enclosed, continuous conveyor overlying the charging holes of each of said coke ovens;

an improved method for preventing jamming of the conveyor drive system when at least a portion of said defined amount of coal is not charged into its associated charging hole, which comprises;

determining when a predetermined minimum height of coal is being transported on the conveyor at a point past its associated point of discharge, determining the longitudinal distance of such coal past its discharge point, by measuring a time-interval analogous to said distance, comparing (i) said measured analogous time-interval with (ii) a preset time-interval analogous to a volume of coal which is considered excessive and which would cause such jamming, and generating a signal when time-interval (i) is greater than time-interval (ii).

5. The method of claim 4, wherein the motion of the conveyor is stopped in response to said generated signal.

* * * * *